United States Patent [19]

Hughes

[11] 4,120,458

[45] Oct. 17, 1978

[54] ROTARY WOOD WASTE GRINDER

[75] Inventor: John H. Hughes, Montesano, Wash.

[73] Assignee: J. H. Hughes, Inc., Montesano, Wash.

[21] Appl. No.: 807,424

[22] Filed: Jun. 17, 1977

[51] Int. Cl.[2] ..... B02C 13/286

[52] U.S. Cl. ..... 241/186 R; 241/189 R; B02C/13/02

[58] Field of Search ..... 241/186 R, 186.4, 189 R, 241/277

[56] References Cited

U.S. PATENT DOCUMENTS

| | | | |
|---|---|---|---|
| 2,650,745 | 9/1953 | Oberwortman | 241/189 R X |
| 3,483,906 | 12/1969 | Moeller | 241/186 R X |
| 3,912,175 | 10/1975 | Anderson | 241/189 R X |
| 4,033,515 | 7/1977 | Barcell et al. | 241/189 R X |

*Primary Examiner*—Howard N. Goldberg

*Attorney, Agent, or Firm*—Seed, Berry, Vernon & Baynham

[57] ABSTRACT

A large diameter rotary drum has an open top and a floor in which are mounted a plurality of freely rotating sprockets having sharpened teeth. Wood wastes, large blocks, trimmings from shake mill operations, broken shakes and the like are deposited into the drum and are carried over the sprockets. The rolling action of the teeth on the wastes grinds the wastes to much smaller pieces which fall through openings around the sprockets and are carried away by a conveyor.

8 Claims, 6 Drawing Figures

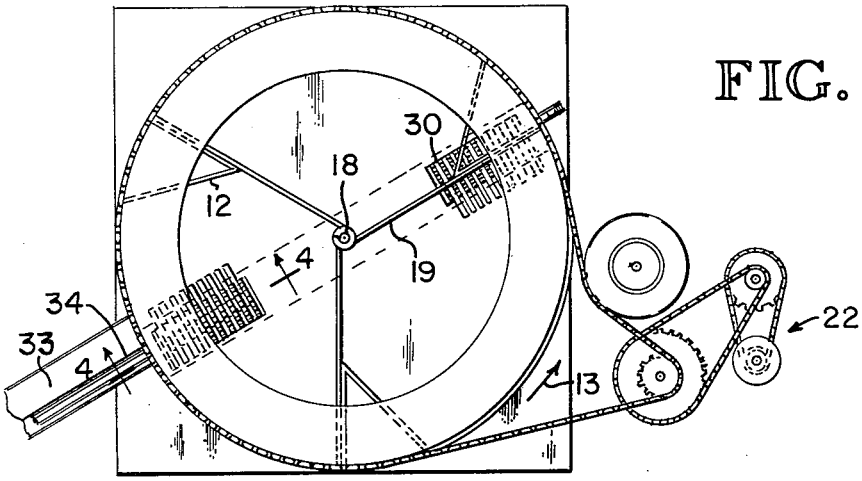
FIG. 3
FIG. 4
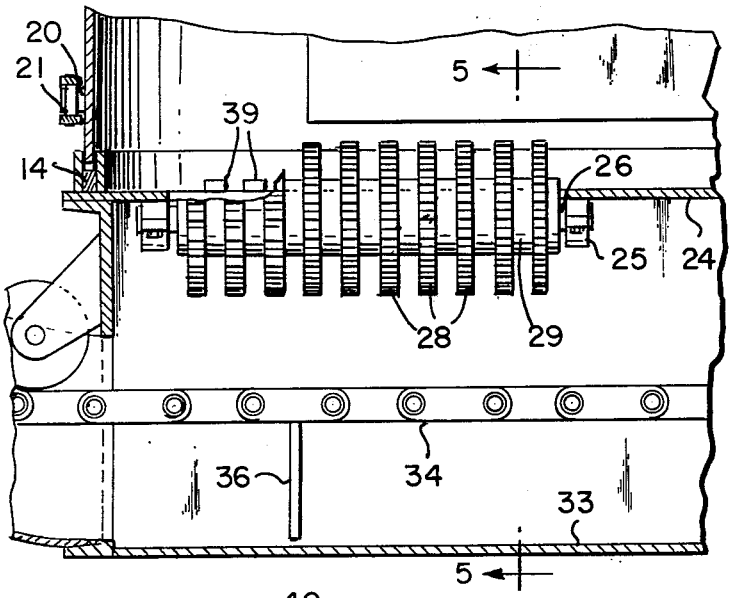
FIG. 5
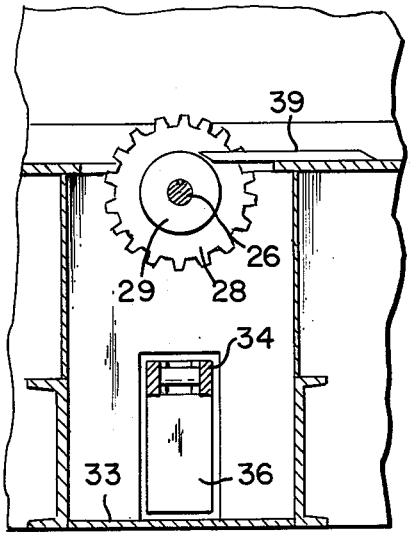
FIG. 6
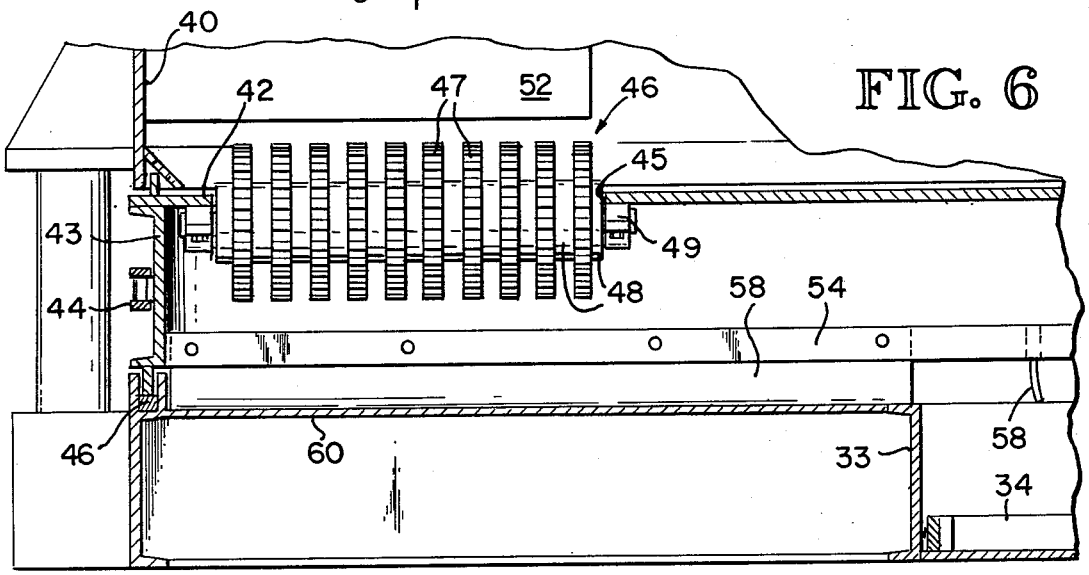

ROTARY WOOD WASTE GRINDER

BACKGROUND OF THE INVENTION

1. Field of the Invention

This invention pertains to grinders, and more particularly to large diameter grinders for pulverizing wood waste materials.

2. Description of the Prior Art

Wood waste grinders presently available are generally small diameter approximately three feet in diameter with powered grinding wheels or discs. As the wastes pile up the load on the rotated discs increases resulting in increased horsepower requirements to rotate the discs. These grinders are generally unsatisfactory because of their limited size and the amount of waste material that can be fed to them. Furthermore, the grinders require large horsepower motors to accommodate the potential high load requirements when the wastes pile up.

SUMMARY OF THE INVENTION

It is an object of this invention to provide an inexpensive wood waste grinder which grinds at a generally fixed rate so that horsepower requirements do not vary substantially. That is, as compared to prior grinders the horsepower requirements are considerably less because in the prior art grinders the cutting elements are required to immediately cut through all the material fed to the grinder whereas in applicant's grinder only a portion of the material need be exposed to the cutting elements and the material can roll past the cutting elements for another pass. As the weight of the pile increases the pressure applied on the cutting elements increases thus increasing cutting action.

It is another object of this invention to provide a wood waste grinder which can hold much larger quantities of wood wastes and employs self-sharpening grinding elements.

It is another object of this invention to provide a wood waste grinder that will be unharmed if hard foreign objects are accidentally fed to it such as steel tools or rocks.

Basically these objects are obtained by providing a large diameter drum aligned with a vertical axis and in one embodiment rotating the drum and a plurality of sweepers attached to the drum over a fixed plate which contains a plurality of spaced freely rotatable sprocket wheels. In a second embodiment the drum is held stationary and a movable bottom plate or floor which contains the sprocket wheels is rotated relative to the drum and its sweepers. In both embodiments the wood waste materials are pushed over the sprocket wheels which rotate and puncture the waste materials until the waste materials are broken down into pieces small enough to fall by gravity between slots surrounding the sprocket wheels. The ground material falls by gravity or in another embodiment by rubber sweepers into a central take-away conveyor.

The horsepower requirements are substantially less (a 30 horsepower 1800 rpm motor will suffice), and enormous quantities of wood waste material can be fed into the drum while the lowermost waste material on the pile is continually being ground and removed. The drum and grinder mechanism is portable and is very simple and easy to manufacture. Since the sprocket wheels pulverize the wood waste by rolling against the materials the teeth are self-sharpened and can go on for long periods of time without replacement. Hard objects, such as steel tools and rocks, can pass over the wheels without causing damage. Furthermore simple readily available sprocket wheels rather than precisely made cutting discs can be used for the sprocket wheel grinders.

BRIEF DESCRIPTION OF THE FIGURES OF THE DRAWING

FIG. 3 is a plan of the grinder shown in FIG. 1.

FIG. 4 is a fragmentary vertical section taken along the line 4—4 of FIG. 3.

FIG. 5 is a fragmentary vertical section taken along the line 5—5 of FIG. 4.

FIG. 6 is a fragmentary vertical section also taken along a line similar to 4—4 but of a modified form of grinder.

DETAILED DESCRIPTION OF THE PREFERRED EMBODIMENTS

Figures 1, 2:
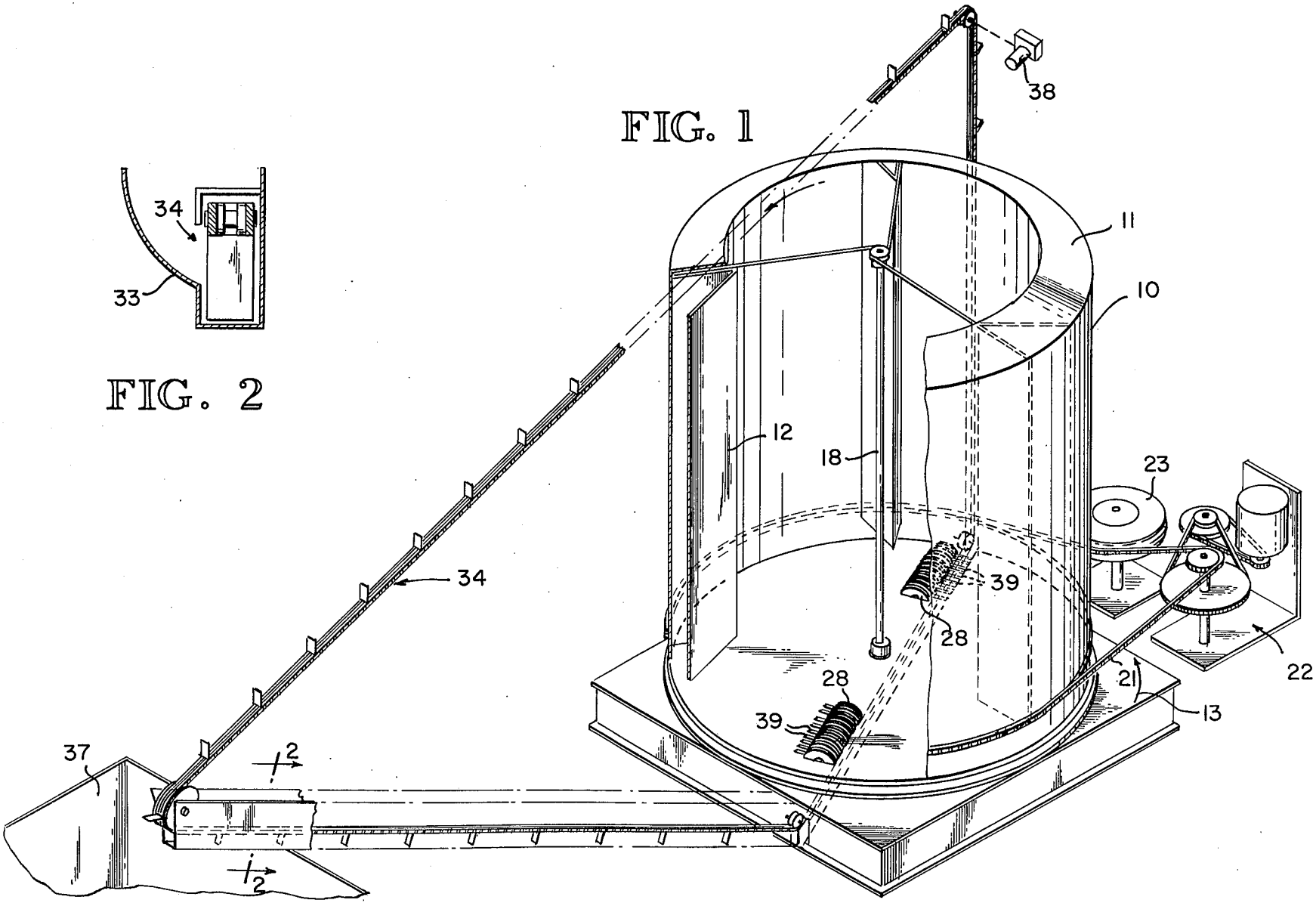
FIG. 1 is an isometric view of a grinder embodying the principals of the invention with parts broken away for clarity.
FIG. 2 is a vertical fragmentary section taken along the line 2—2 of FIG. 1.

As best shown in FIG. 1 the grinder includes a drum 10 with a top flane 11 and a plurality of spaced vertical sweeper plates 12. The drum is rotated in the counterclockwise direction as shown by the arrow 13 in FIG. 3 with the sweeper plates 12 being inclined such that their leading edges are at the periphery of the drum. This assures the wood waste materials at the bottom of the drum are swept outwardly from the peripheral wall. The drum is mounted on a low-friction well-lubricated wear plate 14. The wear plate allows the drum to rotate about a central axis concentric with a center post 18 that is connected to the sweeper plates 12 and the periphery of the drum by upper struts 19. The drum is provided with peripheral circumferentially spaced teeth 20 which are engaged by a flexible chain 21. Chain 21 is powered by drive sprocket, transmission and motor 22 of any conventional configuration. A tire or other suitable idler roller 23 maintains tension on the chain.

Mounted below the drum is a stationary floor or bottom plate 24 which is provided with diametrically spaced bearing blocks 25. The bearing blocks each mount a shaft 26 on which are mounted freely independently rotatable sprocket wheels or grinders 28 separated by spacers 29. The sprocket wheels are heat treated for hardness but are of a type generally used as drive sprockets which are readily available at large production low prices. Each of the wheels is surrounded by a large opening 30 in the floor which allows pulverized waste materials to fall down between the sprocket wheels into a trough 33. A conveyor 34 is provided with paddles 36 which sweep the collected waste material outwardly and upwardly to a container 37. The conveyor 34 is powered by a suitable drive motor 38.

If desired spacer bars 39 can be added between the sprocket wheels upstream in the direction of rotation for preventing large pieces of waste falling through the opening 30.

In the embodiment shown in FIG. 6 the drum 40 remains stationary and a lower plate 42 is mounted on a plate housing 43. The plate housing is rotatably mounted on wear plate 46 so that the plate housing and lower plate 42 are rotated by a chain 44 relative to the stationary drum. An opening 45 is placed around each of a plurality of grinding members 46 of the same construction as in the preferred embodiment, that is, each grinding element includes a freely rotatable sprocket wheel 47 and spacer 48 freely rotatably mounted on a shaft 49. The drum is again provided with stationary sweeper plates 52 that guide the wood waste materials lying on the rotatable plate 42 toward the center of the drum.

Wood waste materials pulverized in this embodiment fall between the sprocket wheels onto a base plate 60. A rubber sweeper 58 coupled to a bracket 54 moves debris or waste pulverized material lying on the base plate 60 toward the center take-away conveyor 34.

While the preferred embodiment of the invention has been illustrated and described it should be understood that variations will be apparent to one skilled in the art without departing from the principles herein. For example, additional grinding wheels can be placed at the bottom of the drum preferably in overlapping spiral relationship completely across the entire surface of the drum. While the preferred embodiments have been described the invention is not to be limited to the specific embodiments illustrated in the drawing.

The embodiments of the invention in which a particular property or priviledge is claimed are defined as follows:

1. A wood waste material grinder comprising:

an upright cylindrical drum having a vertically positioned peripheral wall and an open upper end, plate means closing the lower end of the drum, said plate means having at least two circumferentially spaced openings, grinding means within said openings, said grinding means including a plurality of freely rotatable non-powered grinding wheels each with circumferentially spaced peripheral teeth, means for mounting the wheels for rotation in generally vertical planes generally tangent to radius of the drum, means for moving wood waste material and the wheels relative to one another whereby the wheels rotate and their teeth roll against the materials thereby pulverizing the materials, and means for collecting the pulverized materials.

2. The grinder of claim 1, said wheels comprising conventional sprocket wheels.

3. The grinder of claim 1, said means for moving the wood waste materials including means for rotating the drum and including sweeper means carried by said drum and overlying said plate means for pushing the wood waste materials over the wheels.

4. The grinder of claim 1, said means for moving the wood waste materials including means for rotating the plate means and grinder wheels relative to the drum, said drum including sweeper means for pushing the wood waste materials relative to the rotating plate means.

5. The grinder of claim 4, including a gathering floor beneath said plate means, said gathering floor joined to a trough, conveyor means in said trough, and flexible wiper means secured to the underside of said rotating plate means and engaging said gathering floor for wiping pulverized wood waste material into said trough.

6. The grinder of claim 1, including a stationary gathering floor beneath said openings in said plate means, and conveyor means associated with said gathering floor for removing pulverized wood waste materials.

7. A wood waste grinder comprising storage means for holding a pile of wood waste material, a plurality of freely rotatable, non-powered, toothed wheels located below said storage means, means for moving the pile and wheels relative to one another for engaging the waste material with the toothed wheels, and with the relative movement providing the rotational force to rotate the wheels, and means for carrying the ground material away from the storage means.

8. The grinder of claim 7, said storage means including an upright container having a bottom, said toothed wheels being freely rotatably mounted within openings in said bottom, said openings being larger than said wheels whereby broken waste material falls through said openings.

* * * * *